United States Patent [19]

Felix

[11] 4,334,672

[45] Jun. 15, 1982

[54] APPARATUS FOR AUTOMATICALLY APPLYING SHEET UNITS TO ENDLESS WEB

[75] Inventor: Willi Felix, Strengelbach, Switzerland

[73] Assignee: Jos. Hunkeler AG Fabrik fur graphischë Maschinen, Wikon, Switzerland

[21] Appl. No.: 252,189

[22] Filed: Apr. 8, 1981

Related U.S. Application Data

[63] Continuation of Ser. No. 68,740, Aug. 22, 1979, abandoned.

[30] Foreign Application Priority Data

Jun. 25, 1979 [CH] Switzerland ..... 5913/79

[51] Int. Cl.[3] ..... B42B 2/00

[52] U.S. Cl. ..... 270/53; 156/299; 156/552; 271/243

[58] Field of Search ..... 270/52–53, 270/58, 59; 271/243; 156/299, 303, 548, 552, 556

[56] References Cited

U.S. PATENT DOCUMENTS

| | | | |
|---|---|---|---|
| 3,200,719 | 8/1965 | Welch | 270/53 X |
| 3,540,970 | 11/1970 | Huntwork | 156/556 |
| 3,630,513 | 12/1971 | Davidson | 270/53 |
| 3,649,001 | 3/1972 | Schieven | 270/58 X |
| 3,879,028 | 4/1975 | Frank | 270/52 |
| 4,019,728 | 4/1977 | Liclican | 270/53 X |
| 4,043,551 | 8/1977 | Morrison | 271/243 |
| 4,043,665 | 8/1977 | Caldwell | 271/243 X |
| 4,080,678 | 3/1978 | Muller | 270/53 X |

FOREIGN PATENT DOCUMENTS

| | | | |
|---|---|---|---|
| 545698 | 2/1974 | Switzerland | 270/53 |

*Primary Examiner*—A. Burr Heinz
*Attorney, Agent, or Firm*—James E. Nilles

[57] ABSTRACT

Sheet units to be tipped onto a carrier web of indefinite length are brought into the relationship to one another that they are to have on the web while riding on an upper stretch of an endless carrier. Abutment elements on the endless carrier, at regular intervals along it, define rearwardly facing surfaces that project above said upper stretch and move forward at a predetermined velocity. An endless driver having an upper stretch paralleling that of said carrier and driven faster, frictionally urges sheet units into engagement of their front edges against said surfaces. An air permeable belt, driven at said velocity, has a bottom stretch that is under a suction shoe and the rear portion of which is upwardly adjacent to the front portion of said endless carrier, so that sheet units are sucked off of the carrier and onto said belt to be carried forward by it without change in their edgewise speed. The web extends up toward said belt from beneath it, then forwardly along the belt flatwise contiguous to the undersides of sheet units carried by the belt, for union with them.

3 Claims, 4 Drawing Figures

APPARATUS FOR AUTOMATICALLY APPLYING SHEET UNITS TO ENDLESS WEB

RELATED APPLICATIONS

This application is a continuation of the applicant's copending application, Ser. No. 068,740, filed Aug. 22, 1979, now abandoned, and claims the priority date of Swiss patent appln. No. 5913/79-4, filed June 25, 1979.

FIELD OF THE INVENTION

This invention relates to apparatus for automatically placing individual sheets or slips onto portions of an endless web that are spaced apart by predetermined distances, and for adhesively bonding the applied sheets or slips to the web.

BACKGROUND OF THE PRIOR ART

There has been a long-standing demand for a fast operating, reliable and versatile machine whereby articles in the nature of envelopes, single or manifolded sheets, plastic cards or the like can be attached to a web of indefinite length at regular intervals along the web. The tipped-on articles—whatever their character—will hereinafter be designated sheet units. The web serves as a carrier on which the sheet units can be advanced one-by-one through an automatically operating printing device or the like that performs an operation upon each sheet unit. Thus, depending upon the purpose for which the product is intended, the sheet units may be manifolds consisting of two or more sheets with carbon paper between them, to be put through an automatic billing machine; or they may be plastic cards to be processed through a computer-controlled machine that will apply individual identifying indicia to them; or they may be envelopes to be put through an automatic addressing machine. These are but a few examples of a great and steadily increasing variety of such products for which there is a growing demand.

The machine that produces such product must be capable of attaching the sheet units to the web at accurately maintained uniform intervals, and it must be capable of turning out the product at a high rate of speed. For production economy it is also of great importance that the machine be very versatile, since the demand for tipped-on product changes from time to time, and the production machine must be capable of accommodating changes in demand without having to be shut down for each such change to undergo prolonged modification or adjustment.

A machine of the type here under consideration that has enjoyed substantial commercial success is disclosed in Swiss Pat. No. 545,698, which has a counterpart in U.S. Pat. No. 3,871,639. In that machine the sheet units move in one direction while the endless web moves in the opposite direction until the sheet units and the web reach a location at which they are brought together and adhesively connected. Fixed stops provide for the positioning of the sheet units relative to the endless web. From the location at which the adhesive connection takes place, the web with the attached sheet units moves on in an orderly manner.

Because of the movement in opposite directions of the sheet units and the endless web, the web must be brought to a stop for each sheet unit that is to be connected to it, with the result that production capacity is limited, and therefore this disclosed method and apparatus is unsatisfactory for many conditions.

U.S. Pat. No. 3,540,970 discloses a machine for tipping individual sheets together in pairs or multiples. The machine of this patent is capable of being operated only with individual sheet units that are attached directly to one another. It cannot be employed for attachment of individual sheets or slips to an endless web at spaced apart locations along it.

U.S. Pat. No. 3,249,352 discloses a machine for attaching tab cards to a web of indefinite length. The tab cards had to have perforations along their side edges and the web stock had to be similarly perforated because the perforations were relied upon to establish the cards at the desired locations along the web. The machine was not well adapted for producing other types of product than the one for which it was specifically intended, and it was confined to use with tab cards having dimensions defined by the spacing of the perforations.

U.S. Pat. No. 3,879,028 discloses a more versatile machine, but, again, one that could only operate with sheet units having perforations at fixed spaced intervals and with a web having perforations at the same intervals. The perforation intervals fixed the size increments of the sheet units that could be handled by the machine and imposed a severe limitation upon the variety of products that it could produce.

U.S. Pat. No. 3,200,719 discloses a machine for attaching envelopes to a continuous web. It was intended to operate with imperforate envelopes and an imperforate web, so that in theory it seemed to be capable of tipping sheet units to a web at any desired spacing intervals, rather than being confined to spacing increments fixed by predetermined perforation intervals. Furthermore, it was arranged for continuous travel of its web rather than for intermittent web travel, and in that respect it seemed to promise high production speeds. In fact, however, the machine was not very versatile, and it tended to be slightly inaccurate in its spacing of sheet units along the web. It had a distributing conveyor mechanism by which the sheet units were brought into properly spaced relationship to one another while moving forward towards union with the web; but that mechanism was not capable of arranging the sheet units in overlapping relationship, and therefore the machine could not produce a type of product for which there is a substantial demand. Another deficiency of the machine was more subtle and may not have been apparent in all applications. After the envelopes had been brought into properly spaced relation to one another on the distributing conveyor mechanism, they were fed from that mechanism to a system of roller conveyors by which they were transported to their union with the web. In passing from the distributing conveyor mechanism to the roller conveyor system the envelopes had to be accelerated in their forward edgewise motion. Such acceleration could not take place instantaneously, and therefore there was always a slight slippage between each envelope and rollers of the roller conveyor system. With very uniform envelopes and careful adjustment, that slippage could be the same for every envelope, but any variation in the rate of acceleration from envelope to envelope resulted in irregular spacing of envelopes along the web. Thus the machine was obviously not well adapted for operation with different types of sheet units.

From the foregoing discussion it can be seen that a basic problem in this art has been that of preliminarily establishing sheet units in the spaced relationship that they are intended to have when attached to the web and then maintaining them in that relationship all the way to their union with the web. Any of several known expedients can be employed for bringing sheet units into a desired relationship to one another, whether at slightly spaced intervals, or in edge-to-edge contiguity, or with a predetermined overlap. However, the sheet units cannot be united with a web while they are being carried by any of the known arranging mechanisms, and therefore—especially in a high-production machine wherein the web remains in continuous motion—the sheet units must be transferred from the arranging mechanism to some other device by which their union with the web is brought about.

Various arrangements have been proposed whereby the arranged sheet units and the web are brought together while they are traveling along a curved path defined by a rotating drum or the like. Although apparently satisfactory for many types of product, such arrangements cannot operate satisfactorily with sheet units in the form of relatively thick manifolds, owing to the difference in radius as between the innermost and the outermost sheets of the manifold as it moves around the curved path.

Desirably, therefore, the sheet units should move edgewise in a straight path, not only while they are advancing towards the zone at which they are united with the web but also as they move through that zone, and preferably through some further substantial distance beyond that zone. Furthermore, once the sheet units have been brought into the desired relationship to one another, they should continue their edgewise forward motion at a steady rate, equal to the forward speed of the web, without being accelerated or decelerated in such motion.

In general, what has heretofore been lacking in the art, but has manifestly been needed, is apparatus for applying labels, sheets, slips or the like to an endless web at locations thereon that are spaced apart by predetermined distances, and for causing the individual sheet units to be bonded to the web at those locations, and whereby those operations are accurately performed at very high speed to thus afford a high rate of production.

The general object of the present invention is to satisfy this want.

SUMMARY OF THE INVENTION

In general, this invention provides high speed and very versatile apparatus by which individual sheet units are brought into flatwise engagement with a substantially elongated web and are caused to adhere to the web at locations along its length that are spaced apart by predetermined distances.

An object of the invention is to provide such apparatus that is capable of operating with both sheet units and web stock that can be imperforate, so that there is no constraint, such as might be imposed by fixed perforation spacing, upon the size of the sheet units or the spaces between the locations at which they are attached to the web.

It is a further object of the invention to provide such apparatus that is capable of attaching sheet units to a web with any desired relationship between sheet units, whether at spaced intervals, or edgewise contiguous to one another or in overlapped relation.

It is also an object of the invention to provide such apparatus that is capable of operating satisfactorily with relatively thick sheet units, including manifolded sheet units comprising many sheets.

The apparatus of this invention is characterized by carrier means defining an upwardly facing substantially horizontal carrier surface upon which sheet units are supported and guided for edgewise movement in a direction towards and beyond a front portion of said surface, with an edge portion of each sheet unit extending substantially transversely to said direction. The apparatus has sheet unit forwarding means comprising a plurality of abutment elements, each having a substantially upright abutment surface which projects above said carrier surface and which is engageable by said edge portion of a sheet unit thereon.

Said abutment elements are arranged with their said abutment surfaces spaced apart in said direction by said distances and are constrained in unison motion in said direction at a predetermined velocity. Sheet control means frictionally engageable with sheet units on said carrier surface urge said sheet units towards engagement of their said edge portions with said abutment surfaces. The apparatus has suction shoe means for drawing air upwardly; and an air permeable belt having a bottom stretch which extends horizontally in said direction across the suction shoe means, to have air drawn upwardly therethrough, is driven forwardly in said direction at said velocity. The bottom stretch of the air permeable belt has a rear portion upwardly adjacent to said front portion of said carrier surface, so that sheet units are lifted off of the carrier surface and are attached by suction to said bottom stretch, for forward travel therewith while maintaining said velocity in their edgewise forward travel. The apparatus also has web guide means for guiding an elongated web upwardly towards said bottom stretch of the belt from beneath the same and thence forwardly along and in flatwise proximity to said stretch, to be flatwise contiguous to sheet units carried thereby, and web drive means for pulling the web lengthwise at said velocity.

Preferably the carrier means comprises an endless carrier on which the abutment elements are carried and which has an upper stretch extending in said direction, driven for forward movement in said direction at said velocity, and acceleration means driven for forward movement in said direction at a speed faster than said velocity and arranged to frictionally engage sheet units on said upper stretch and urge them towards engagement of their front edge portions against the upright surfaces on the abutment elements.

BRIEF DESCRIPTION OF DRAWINGS

In the accompanying drawings, which are purely schematic but which nevertheless illustrate what is now regarded as a preferred embodiment of the invention.

DETAILED DESCRIPTION OF PREFERRED EMBODIMENT

Figure 1:
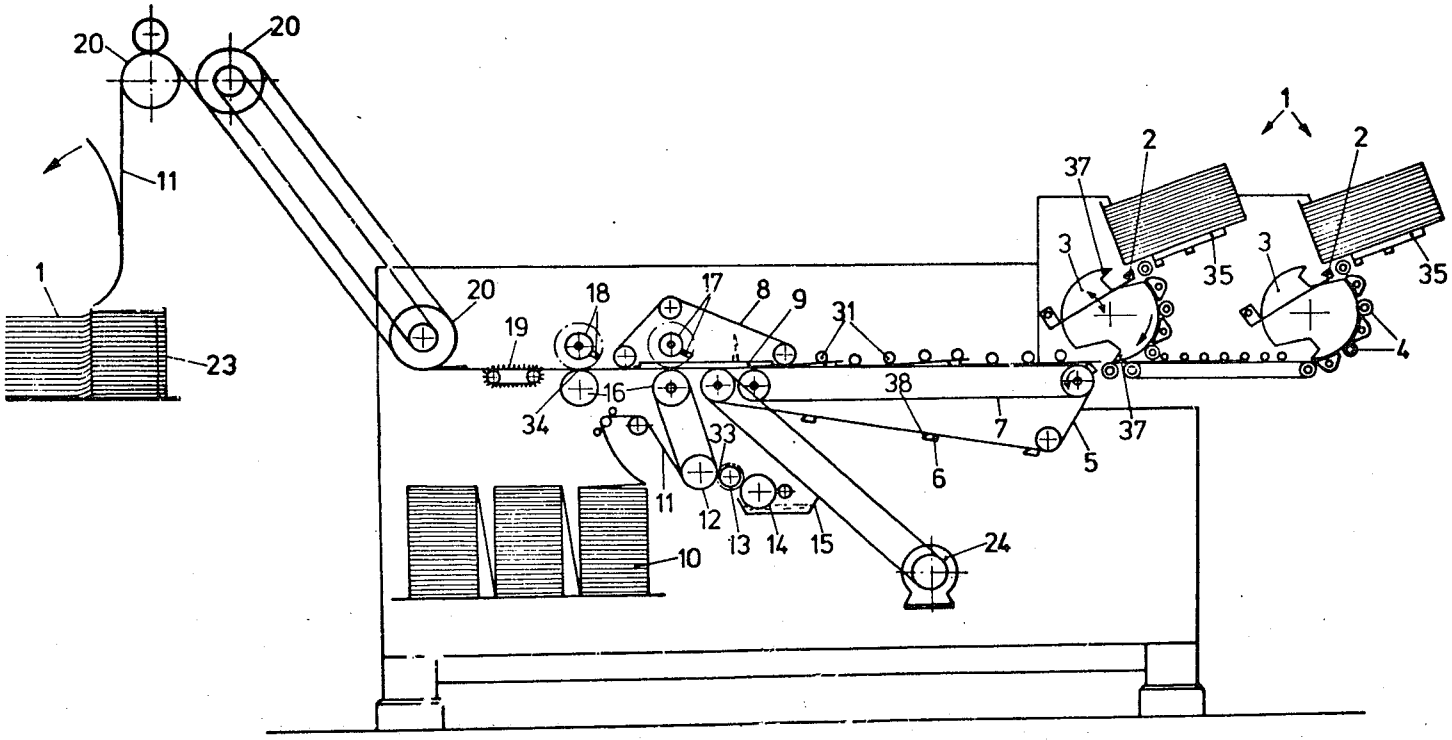
FIG. 1 is a side view of a machine for automatically placing individual sheets, slips or the like onto an endless web.

The individual sheets, slips, labels or the like that are to be applied, which are designated by 1 and which may be forms, carbon copy manifold elements or the like, are hereinafter referred to as sheet units. The sheet units 1 are supported in piles, each pile being located over a pick-up cam or feed drum 3. As shown, there are two such piles, which can be assumed to comprise two different kinds of sheet units 1, each in its own pile; but there may be only one such pile and its pick-up cam or feed drum 3. For those skilled in the art, synchronization of the pick-up drums 3 to feed sheet units 1 off of the respective piles in a required order presents no problems that are of significance to the present invention.

Adjacent to each pick-up drum 3 is a vacuum sucker 2 which is mounted to swing up to a position of engagement with the lowermost sheet unit 1 in the associated pile and a lowered position in which the vacuum sucker 2 presents a sheet unit attached to it by suction to the grip of transport rollers 4. The transport rollers 4 are supported on the machine frame for rotation at fixed locations, and collectively they extend partway around the periphery of the pick-up drum 3. The pick-up drum 3 is drivingly connected to move in synchronism with a chain or toothed belt 5 that has striker dogs 6 on its outer surface, fixed to it at uniform intervals along its length. A substantially horizontal upper stretch of the chain or toothed belt 5 extends forwardly from near the bottom of the pick-up drum 3. Preferably there are a pair of the chains or toothed belts 5 that extend in parallel to one another and are spaced laterally at equal distances to opposite sides of the longitudinal centerline of the machine frame, as can be seen in FIG. 2.

Figure 2:
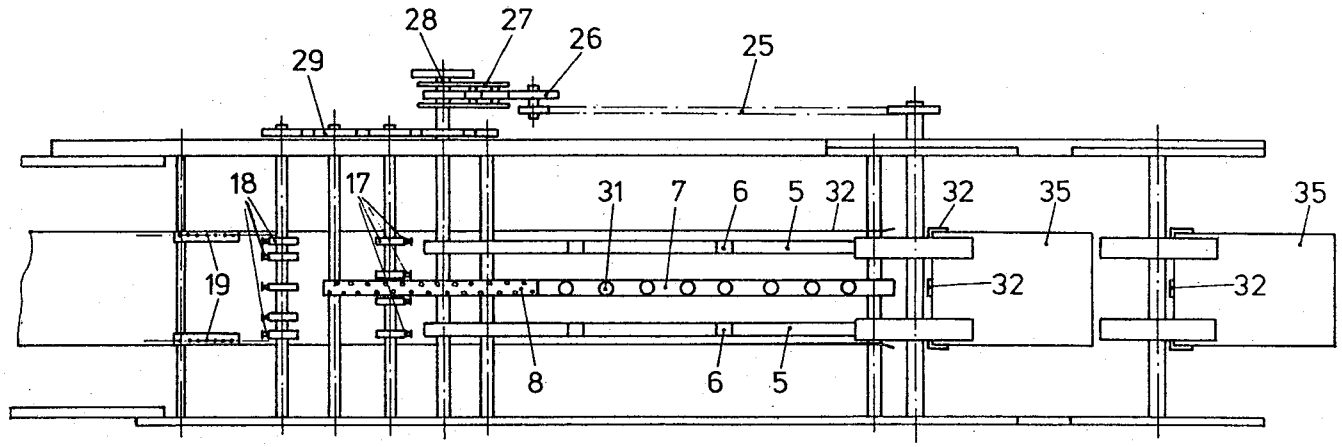
FIG. 2 is a top view of the machine that is shown in FIG. 1.
Figure 3:
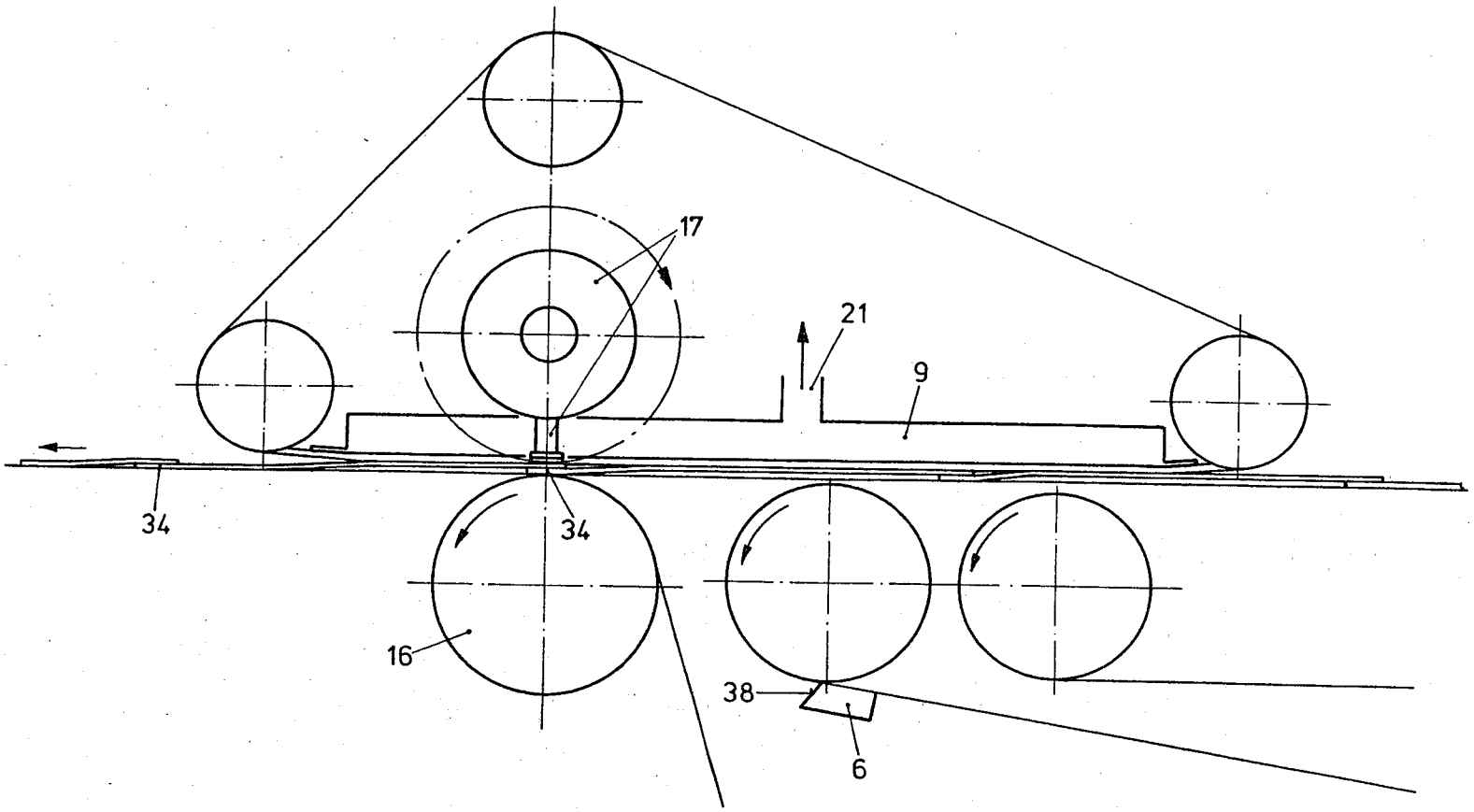
FIG. 3 is a fragmentary view of the machine in longitudinal section, taken at the suction station and the pasting location.
Figure 4:
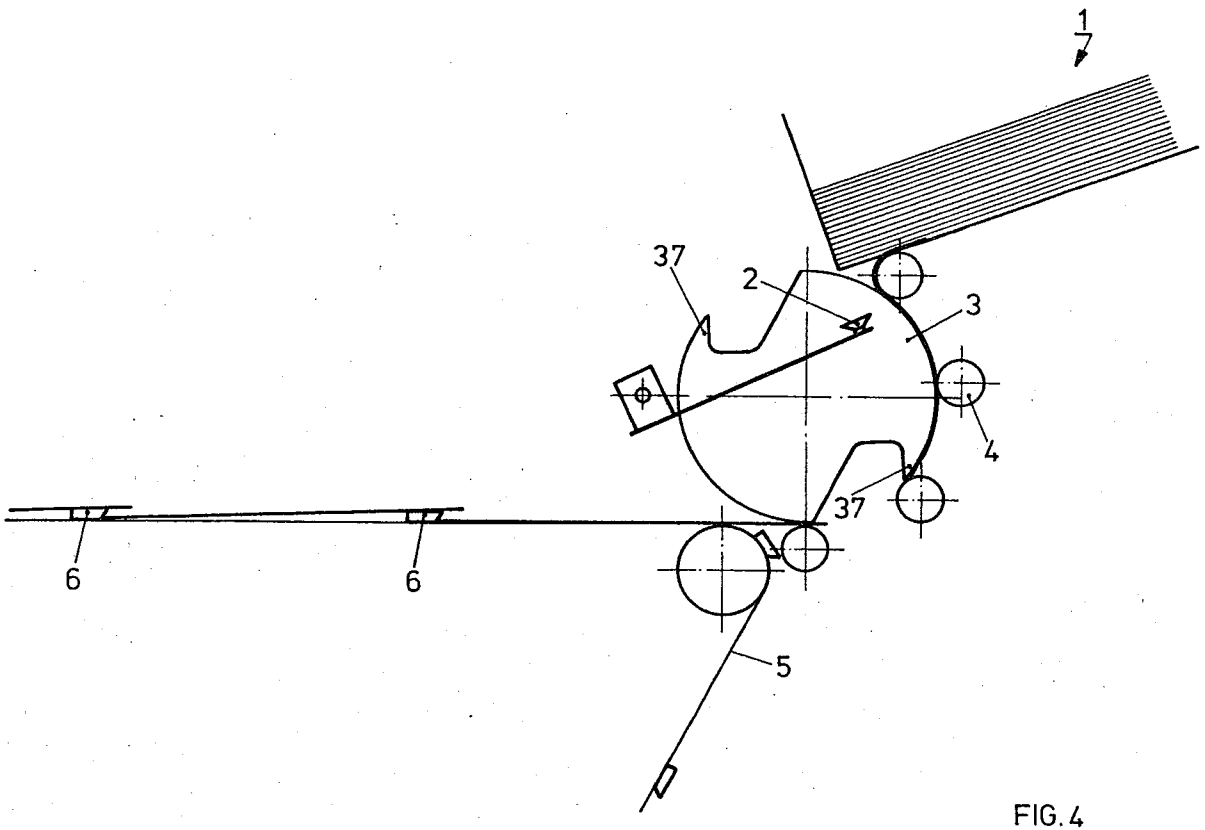
FIG. 4 is another fragmentary view of the machine, in longitudinal section, taken at the feed station.

As FIG. 2 also shows, there is an acceleration belt 7 between the two toothed belts or chains 5 that has its forwardly extending upper stretch coplanar with their upper stretches. Directly over the acceleration belt 7, along a substantial portion of its length, are balls 31, arranged in a known manner to urge sheet units 1 down into engagement with the acceleration belt 7 but to permit some slippage between that belt and the sheet units. Directly over the front end portion of the acceleration belt 7 is an apertured endless belt 8 which has a lower stretch that extends forwardly across a suction shoe 9 connected with a vacuum source 21 (see FIG. 3). As the apertured belt 8 passes under the suction shoe 9, air is drawn up through the holes in it, and the sheet units 1 that have been forwarded to the belt 8 from the transport rollers 4, and by way of the belts or chains 5, are synchronously transported forwardly on the underside of the apertured belt 8, securely held to it by suction.

An endless sheet or carrier web 11 is supported in a pile 10. It is led over rollers to and past a counterpressure roller 12, which is supported for rotation opposite a so-called cliché (impression) cylinder 13. Rotatably supported in front of the latter is an adhesive roller 14 which dips into liquid adhesive in an adhesive holder 15. The counter pressure roller 12 is drivingly connected with another counterpressure roller 16, which is arranged opposite plural rollers that are each provided with one or more pressure dies 17. Forwardly of the rollers having the pressure dies 17 is another similar roller that has pressure dies 18, opposed by a further counterpressure roller 16. Spaced forwardly from the pressure dies 18 are two pullers 19, arranged at like elevations, which comprise web drive means that effect the continuous forward movement of the carrier web 11 by engaging their tangs in mating perforations in it. Finally, the carrier web 11 arrives at a guide roller 20, followed by a similar such roller 20, and, after passing around the front guide roller 20, the endless web, with the sheet units 1 attached to it, falls of its own weight down onto a delivery table, on which it forms a pile 23 in a known manner.

The machine is driven by means of an electric motor 24 which imparts rotation to a drive shaft 28 having drive gears 29 by means of a drive transmission 25 (FIG. 2), a gear 26 and change gears 27 with suitable gearing. It will be understood that the pick-up drums 3, the swinging suckers 2, the several belts and driven rollers and the pushers 19 are synchronized with one another by their driving connections with the transmission system 24–29.

In order to securely establish a pile of the sheet units 1 in the right position, there are provided the socalled emplacements seen in FIG. 2, comprising rails 32 which also serve to guide the fed-in sheet units 1 to the right positions along the toothed belt 5.

In order to apply adhesive material to the exact locations on the web 11 at which sheet units 1 are to be attached thereto, the impression cylinder 13 has a rubber element 33 (there can be several, in suitable positions on it), which receives adhesive from the adhesive roller 14 and carries the adhesive onto the carrier web at the intended locations for it. The sheet unit 1 is brought into contact with the adhesive applied to the carrier web 11 at the location 34, between the first counter-roller 16 and the press die 17.

A machine of this type functions as follows:

The sheet units 1 are piled on a table 35 which has its upper surface approximately tangential to the pick-up drum 3. The emplacements 32 at the sides and front of the table 35 position the sheet units. If sheet units 1 are bonded together to form carbon copy manifolds, they must have their closed ends (heads) directed towards the pick-up drum 3.

The vacuum suckers 2 tilt the front portions of the sheet units downwardly, and rotation of the pick-up drum 3 brings one of the noses 37 thereon into engagement with the sheet unit 1 to drive the sheet unit into the grip of the first driven transport roller 4. The several transport rollers 4 carry the sheet unit downwardly, around the rear of the pick-up drum 3, and as it passes the last transport roller 4, the sheet unit 1 begins to move horizontally away from the pick-up drum 3. At this point the sheet unit is picked up by the toothed belts or chains 5, which have their striker dogs 6 arranged for exact positioning of the sheet unit 1. The acceleration belt 7, which runs somewhat faster than the toothed belt 5, tends to move each sheet unit 1 forwardly relative to the toothed belts 5, the sheet unit being meanwhile pressed down against the acceleration belt 7, for frictional but slippable engagement with it, by the balls 31. This forces each sheet unit 1 forwardly into firm engagement of its head end against the oblique rear surface 38 of one of the striker dogs 6 on the toothed belt or chain 5. If the sheet units 1 are not to be applied to the web 11 in overlapping relation to one another, the distance between successive striker dogs 6 is equal to or greater than the length of an individual sheet unit 1. If the sheet units 1 are to overlap one another, the distance between striker dogs 6 is smaller than the sheet unit length. The striker dogs 6 are so formed that for sheet units which overlap, each lifts the foot of a sheet unit 1 so that the head of the next sheet unit 1 can securely bear against the oblique rear surface 38 of the same striker dog 6.

During this phase of their transport, the sheet units are also sidewardly aligned by the rails 32 that extend forwardly along the belts 5 and 7 (see FIG. 2).

Thus, when the sheet units 1 have been moved forwardly as far as the perforated belt 8, they have been accurately established in positions of register relative to one another, which positions are determined by the striker dogs 6 and the rails 32; and they are also in accurate positions of register in relation to the endless carrier or web 11, inasmuch as the web transport system comprising rollers 12, 13, 14 and 16 and the puller 19 is synchronized with the toothed belt or chain 5 that carries the striker dogs 6.

At this point the sheet units 1 come under the perforated belt 8, which is passing under the suction shoe 9 and running at the same speed as the toothed belt or chain 5. The sheet units 1 are successively sucked onto the underside of the perforated belt 8, which takes over their further forward transport while maintaining the registering relationship previously established. Thus, the sheet units are neither accelerated not decelerated in their edgewise forward motion as they are transferred to the air permeable belt 8 from the transport and arranging means that comprises the dogs 6, the endless carrier 5 on which they are mounted, and the acceleration belt 7. Instead, each sheet unit maintains the same steady forward speed as it progresses from the front portion of the arranging means to and beyond the location where it is united with the web 11, which speed is equal to the speed of advance of the web.

The carrier web 11 is pulled off of the stack 10 over guide rollers and over the rollers 12 and 16 by means of the two tang-equipped puller 19. It will be seen that the web 11 moves upwardly into the horizontal plane in which the sheet units are moving, entering that plane beneath the suction shoe 9 and thus in a zone in which the sheet units are moving steadily in registering relationships that were established for them while they were being carried by the toothed belt or chain 5.

Before the web 11 moves into the substantially horizontal plane in which the sheets units 1 are transported forwardly, adhesive material is applied to the web 11 by the adhesive cylinder 14. By means of the rubber elements 33 secured to the impression cylinder 13, the adhesive material is applied only to selected surface portions of the adhesive cylinder 14, and therefore the cylinder 14 transfers the material only to predetermined areas on the web 11. The impression cylinder 13 is interchangeable and has a circumference corresponding to the desired adhesion distance between sheet units 1. The press dies 17 and 18 are likewise interchangeable, each comprising an entire unit with shaft, bearings and gear for different adhesive area shapes and distances. The web 11 is so carried up to the roller 16 that each sheet unit 1 meets an area of adhesive material on the web 11 as the sheet unit and the web come together at the adhesion location 34, where they pass between the rotating pressure dies 17 and their opposing counterforce roller 16. There the rotating pressure dies 17 press the sheet unit 1 onto the carrier web 11 to bond them together. By means of the subsequent pressure dies 18, the adhesion locations across the width of the web 11 and sheet unit 1 that have not yet been subjected to bonding pressure are rollingly clamped.

The carrier web 11 with the sheet units 1 is then led upward over the driven guide rollers 20. By its own weight, the carrier web with the sheet units attached falls down onto the delivery table and in a known manner forms the stack 23.

In order to be able to apply the sheet units 1 to carrier web 11 at different adhesion distances, the belts or chains 5 with the striker dogs 6 must be interchangeable. Each such belt or chain 5 is therefore preferably made up of a multiplicity of modular parts. In order for the pick-up drum 3 to rotate synchronously with the striker dogs 6, the rotational speed of the drum 3 must be matched to the driven speed of the toothed belt or chain by insertion of a suitable speed change gear 26. The impression cylinder 13 must have a circumference that corresponds to a desired distance between sheet units 1 along the web 11, or to a multiple of such distance, and therefore the impression cylinder 13 should likewise be interchangeable.

It will be apparent that the several interchangeable parts should be designed in cooperating groups and should be interchanged with one another as groups for adapting the machine to different sheet unit spacings and arrangements.

What I claim is:

1. Apparatus by which individual sheet units are brought into flatwise proximity to a substantially elongated web for adhesion to the web at locations along its length that are spaced apart by predetermined distances, said apparatus being characterized by:

A. transport means for supporting sheet units for edgewise motion in a forward horizontal direction, accelerating them to a predetermined velocity and establishing them in positions relative to one another that they are to have on a web, said transport means comprising (1) endless carrier means having an upper stretch extending in said direction and driven for movement in said direction at said velocity, (2) abutment means on said endless carrier means, operative in said upper stretch thereof to provide upwardly extending rearwardly facing surfaces against which front edge portions of sheet units on said transport means can be engaged, and (3) acceleration means driven for movement in said direction at a speed faster than said velocity and arranged to frictionally engage sheet units on said transport means to urge them towards engagement on their front edge portions against said surfaces;

B. an endless belt having perforations therethrough that open to inner and outer faces thereof and having a horizontal bottom stretch extending in said direction, said belt (1) being driven for movement of its bottom stretch in said direction at said velocity and (2) having a rear portion of its bottom stretch upwardly adjacent to a front portion of said upper stretch of the endless carrier means;

C. suction means at said bottom stretch of the belt, adjacent to the inner surface thereof, for drawing air upwardly through the perforations therein to lift sheet units from said transport means and attach them to said bottom stretch by suction for movement therewith without change in their edgewise velocity;

D. web guide means for guiding an elongated web upwardly towards said bottom stretch of the belt from beneath the same and thence forwardly along and in close flatwise proximity to said bottom stretch of the belt to be flatwise contiguous to sheet units attached thereto; and E. web drive means near the front end of said bottom stretch of the belt for pulling said web lengthwise at said velocity.

2. Apparatus for fastening individual sheet units flatwise to a substantially elongated web at locations along its length that are spaced apart by predetermined distances, said apparatus being characterized by:

A. sheet unit conveyor means (1) defining an upwardly facing surface lying substantially in a single horizontal plane and on which sheet units are supported for substantially edgewise movement, (2) said conveyor means comprising (a) an endless carrier having a straight stretch lying substantially in said plane and extending in opposite forward and rearward directions;

(b) means driving said endless carrier for movement of its said stretch in said forward direction at a predetermined speed, (c) a plurality of abutment elements on said endless carrier, spaced apart therealong by said distances and each so projecting therefrom as to extend across said plane from said straight stretch, and (d) friction means arranged for sliding engagement with each sheet unit on said surface and whereby each such sheet unit is urged edgewise in one of said directions to be maintained engaged with one of said abutments and thus constrained to move at said speed in said forward direction;

B. feeder means for transferring sheet units successively from a supply thereof to a rear end portion of said conveyor means;

C. means defining a suction shoe that has an open bottom into which air is drawn upwardly;

D. an air permeable belt having a bottom stretch which (1) extends horizontally in said directions, (2) has a rear portion upwardly adjacent to a front portion of said surface of the conveyor means, and (3) underlies the bottom of said suction shoe to have air drawn upwardly therethrough whereby sheet units are lifted off of said front portion of the conveyor means and attached by suction to said bottom stretch, said belt being driven to have its bottom stretch move in said forward direction at said predetermined speed;

E. web guide means for guiding an elongated web upwardly towards said bottom stretch of the belt from beneath the same and thence forwardly along and in flatwise proximity to said bottom stretch to be flatwise contiguous to sheet units carried by said bottom stretch;

F. web drive means for pulling said web lengthwise at said predetermined speed; and G. cooperating upper and lower force applying means, at opposite sides of said plane, spaced forwardly from said rear portion of said bottom stretch, for applying flatwise convergent forces to the web and to sheet units flatwise contiguous thereto.

3. The apparatus of claim 2, further characterized by:

(1) said straight stretch of said endless carrier being a top stretch and defining a part of said surface; and (2) said friction means comprising an endless acceleration belt having a top stretch which defines another part of said surface, said acceleration belt being driven to have its top stretch move in said direction at a speed faster than said predetermined speed.

* * * * *